US011609029B2

(12) United States Patent
Kawabata

(10) Patent No.: US 11,609,029 B2
(45) Date of Patent: Mar. 21, 2023

(54) OIL RETURN FLOW PATH FOR A COMPRESSOR

(71) Applicant: DAIKIN INDUSTRIES, LTD., Osaka (JP)

(72) Inventor: Shinichi Kawabata, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/730,624

(22) Filed: Apr. 27, 2022

(65) Prior Publication Data

US 2022/0252310 A1 Aug. 11, 2022

Related U.S. Application Data

(63) Continuation of application No. PCT/JP2020/038261, filed on Oct. 9, 2020.

(30) Foreign Application Priority Data

Oct. 29, 2019 (JP) ..... JP2019-196441

(51) Int. Cl.
*F04C 23/00* (2006.01)
*F04C 29/02* (2006.01)
(Continued)

(52) U.S. Cl.
CPC ..... *F25B 31/004* (2013.01); *F04C 23/008* (2013.01); *F04C 29/025* (2013.01);
(Continued)

(58) Field of Classification Search
CPC .... F25B 31/004; F04C 29/025; F04C 29/028; F04C 29/021; F04C 23/008; F04C 18/0215
See application file for complete search history.

(56) References Cited

U.S. PATENT DOCUMENTS

2009/0238703 A1 9/2009 Jeong et al.
2012/0294733 A1* 11/2012 Yamada ..... F04B 49/06 417/63
(Continued)

FOREIGN PATENT DOCUMENTS

JP 2008-10929 A 1/2008
JP 2010-106790 A 5/2010
(Continued)

OTHER PUBLICATIONS

International Preliminary Report of corresponding PCT Application No. PCT/JP2020/038261 dated May 12, 2022.
(Continued)

*Primary Examiner* — Deming Wan
(74) *Attorney, Agent, or Firm* — Global IP Counselors, LLP

(57) ABSTRACT

A compressor includes a casing that stores lubricant at a bottom, a compression mechanism disposed in the casing to suck and compress a refrigerant, and an oil return member forming an oil return flow path that extends in a top-to-bottom direction to guide the lubricant discharged from the compression mechanism downward. The oil return flow path includes a uniform-cross-section flow path, and a varying-cross-section flow path continuous with a lower end of the uniform-cross-section flow path. A lower end of the varying-cross-section flow path forms an outlet of the oil return flow path and lies along an inner surface of the casing. A the lower end of the varying-cross-section flow path has a greater width than an upper end of the varying-cross-section flow path, and the lower end of the varying-cross-section flow path has a smaller thickness than the upper end of the varying-cross-section flow path.

16 Claims, 6 Drawing Sheets

(51) Int. Cl.
*F04C 18/02* (2006.01)
*F25B 31/00* (2006.01)

(52) U.S. Cl.
CPC ..... *F04C 2210/26* (2013.01); *F04C 2240/30* (2013.01); *F04C 2240/40* (2013.01); *F04C 2240/60* (2013.01)

(56) References Cited

U.S. PATENT DOCUMENTS

2012/0297818 A1* 11/2012 Toyama ..... F04C 23/008 418/55.6
2014/0127057 A1* 5/2014 Nishide ..... F16C 33/103 417/410.5
2019/0301458 A1* 10/2019 Yosuke ..... F04C 29/02

FOREIGN PATENT DOCUMENTS

JP 2015-36515 2/2015
JP 2016-200046 A 12/2016

OTHER PUBLICATIONS

International Search Report of corresponding PCT Application No. PCT/JP2020/038261 dated Dec. 22, 2020.
European Search Report of corresponding EP Application No. 20 88 2553.9 dated Oct. 17, 2022.

* cited by examiner

OIL RETURN FLOW PATH FOR A COMPRESSOR

CROSS-REFERENCE TO RELATED APPLICATIONS

This is a continuation of International Application No. PCT/JP2020/038261 filed on Oct. 9, 2020, which claims priority to Japanese Patent Application No. 2019496441, filed on Oct. 29, 2019. The entire disclosures of these applications are incorporated by reference herein.

BACKGROUND

Technical Field

The present disclosure relates to a compressor.

Background Art

A compressor for use in a refrigeration apparatus, such as an air conditioner, has been known in the art. Japanese Unexamined Patent Publication No, 2016-200046 discloses a so-called hermetic compressor. This compressor includes a casing, and a compression mechanism and a motor that are housed in the casing. An oil return guide is provided between the compression mechanism and the motor. An oil return passage (an oil return flow path) is formed between the oil return guide and the inner wall surface of the casing. The oil return passage guides lubricant discharged from the compression mechanism to a space below the motor.

SUMMARY

A first aspect of the present disclosure is directed to a compressor including a casing configured to store lubricant at a bottom of the casing, a compression mechanism disposed in the casing to suck and compress a refrigerant, and an oil return member forming an oil return flow path that extends in a top-to-bottom direction to guide the lubricant discharged from the compression mechanism downward. The oil return flow path includes a uniform-cross-section flow path having a uniform cross-sectional shape, and a varying-cross-section flow path continuous with a lower end of the uniform-cross-section flow path and having a cross-sectional shape that varies. A lower end of the varying-cross-section flow path forms an outlet of the oil return flow path and lies along an inner surface of the casing. In a case in which a length of a cross section of the varying-cross-section flow path along the inner surface of the casing is a width, and a length of the cross section of the varying-cross-section flow path perpendicular to the inner surface of the casing is a thickness, the cross section of the lower end of the varying-cross-section flow path has a greater width than a cross section of an upper end of the varying-cross-section flow path, and the cross section of the lower end of the varying-cross-section flow path has a smaller thickness than the cross section of the upper end of the varying-cross-section flow path.

DETAILED DESCRIPTION OF EMBODIMENT(S)

An embodiment will be described.

Compressor

Figure 1:
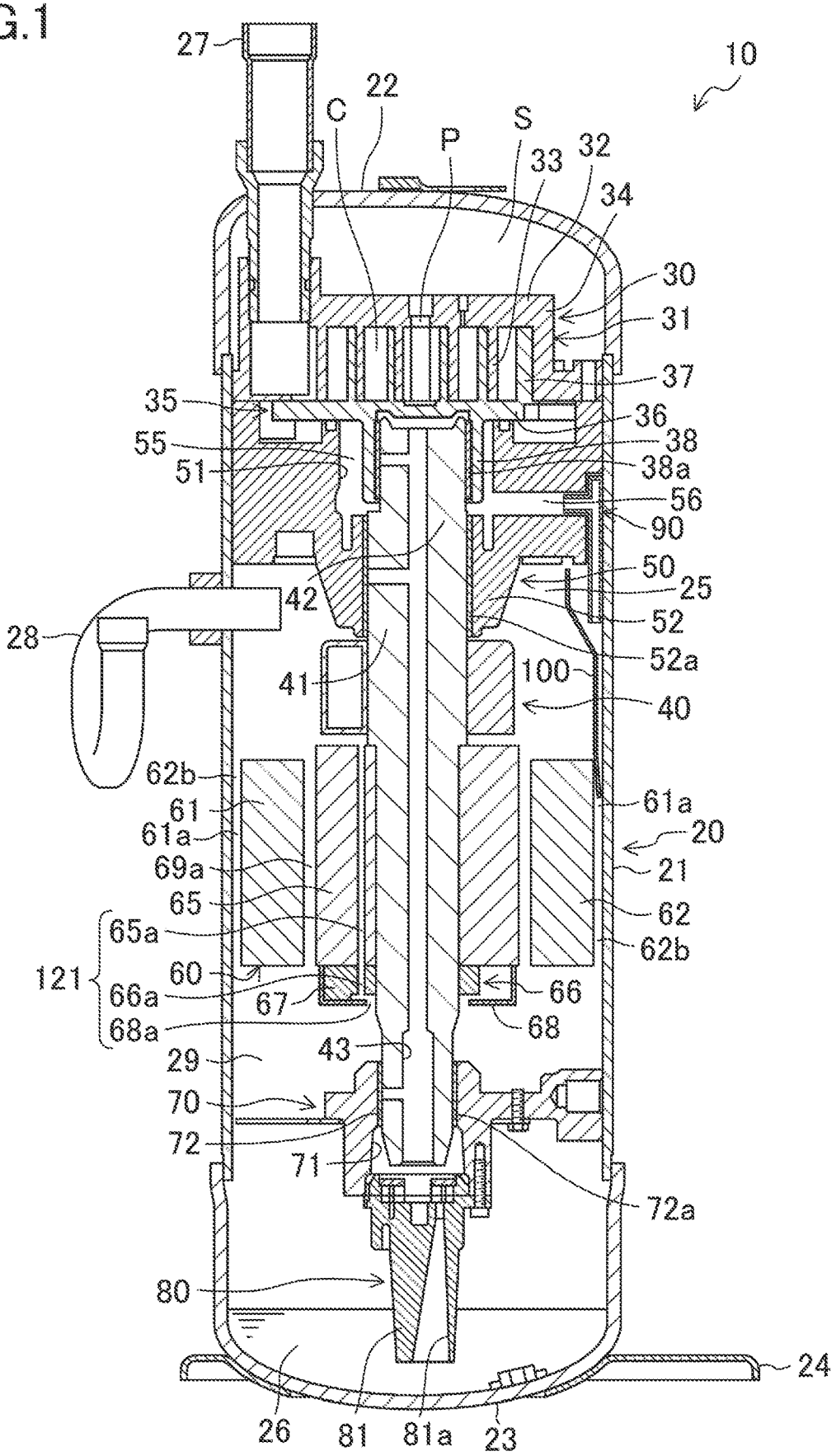
FIG. 1 is a vertical sectional view illustrating a configuration of a scroll compressor according to an embodiment.

As illustrated in FIG. 1, a compressor (10) is a scroll compressor. The scroll compressor (10) is connected to, for example, a refrigerant circuit of an air conditioner. This refrigerant circuit performs a vapor compression refrigeration cycle. In such a refrigerant circuit, a refrigerant (a fluid) compressed by the compressor (10) dissipates heat in a condenser, and is decompressed by a decompression mechanism. Then, the decompressed refrigerant evaporates in an evaporator, and is sucked into the compressor (10).

The compressor (10) includes a casing (20), a compression mechanism (30), a drive shaft (40), a housing (50), an electric motor (60), a lower bearing member (70), and an oil pump (80). Inside the casing (20), the compression mechanism (30), the housing (50), the electric motor (60), the lower bearing member (70), and the oil pump (80) are arranged in this order from the top to the bottom.

Casing

The casing (20) is configured as a vertically long cylindrical closed container. Specifically, the casing (20) includes a barrel (21), a first end plate (22), a second end plate (23), and a leg (24). The barrel (21) is in the shape of a cylinder with both axial (upper and lower) ends open. The first end plate (22) closes one axial end (upper end) of the barrel (21). The second end plate (23) closes the other axial end (lower end) of the barrel (21). The leg (24) is provided on the lower side of the second end plate (23) to support the casing (20).

The casing (20) is connected to a suction pipe (27) and a discharge pipe (28). The suction pipe (27) axially penetrates the first end plate (22) of the casing (20), and communicates with a compression chamber (C) of the compression mechanism (30). The discharge pipe (28) opens in a space above the electric motor (60) in the casing (20). The discharge pipe (28) radially penetrates the barrel (21) of the casing (20), and communicates with a space (25) below the housing (50) (more specifically, a space between the housing (50) and the electric motor (60)).

An oil reservoir (26) is provided at the bottom of the casing (20). The oil reservoir (26) stores lubricant for lubricating sliding components inside the compressor (10).

Compression Mechanism

The compression mechanism (30) sucks, and compresses, a fluid (e.g., a refrigerant), and discharges the compressed fluid into the casing (20). The compression mechanism (30) is provided in the casing (20). The compression mechanism (30) includes a fixed scroll (31), and an orbiting scroll (35) meshing with the fixed scroll (31).

Fixed Scroll

The fixed scroll (31) includes a fixed end plate portion (32), a fixed wrap (33), and an outer peripheral wall portion (34). The fixed end plate portion (32) is in the shape of a disk. The fixed wrap (33) is in the shape of a spiral wall that draws an involute curve, and protrudes from the front surface (lower surface) of the fixed end plate portion (32). The outer peripheral wall portion (34) surrounds the outer peripheral side of the fixed wrap (33), and protrudes from the front surface (lower surface) of the fixed end plate portion (32). The distal end surface (lower surface) of the outer peripheral wall portion (34) is substantially flush with the distal end surface of the fixed wrap (33).

Orbiting Scroll

The orbiting scroll (35) includes an orbiting end plate portion (36), an orbiting wrap (37), and a boss portion (38). The orbiting end plate portion (36) is in the shape of a disk. The orbiting wrap (37) is in the shape of a spiral wall that draws an involute curve, and protrudes from the front surface (upper surface) of the orbiting end plate portion (36). The boss portion (38) is in the shape of a cylinder, and is disposed on a central portion of the back surface (lower surface) of the orbiting end plate portion (36). A bearing metal (38*a*) is fitted to the inner surface of the boss portion (38).

Compression Chamber, Discharge Port, Discharge Chamber

In the compression mechanism (30), the orbiting wrap (37) of the orbiting scroll (35) is meshed with the fixed wrap (33) of the fixed scroll (31). This forms a compression chamber (the compression chamber (C) where a fluid is to be compressed) surrounded by the fixed end plate portion (32) and fixed wrap (33) of the fixed scroll (31) and the orbiting end plate portion (36) and orbiting wrap (37) of the orbiting scroll (35).

The fixed end plate portion (32) of the fixed scroll (31) has a discharge port (P), The discharge port (P) axially penetrates a central portion of the fixed end plate portion (32) to communicate with the compression chamber (C). A space between the fixed scroll (31) and the first end plate (22) of the casing (20) forms a discharge chamber (S), which communicates with the discharge port (P). The discharge chamber (S) communicates with the space (25) below the housing (50) through a discharge passage (not shown) formed in the fixed scroll (31) and the housing (50). The space (25) below the housing (50) constitutes a high-pressure space that is filled with a high-pressure fluid (e.g., a high-pressure discharged refrigerant).

Drive Shaft

The drive shaft (40) extends inside the casing (20) in a top-to-bottom direction. Specifically, the drive shaft (40) extends in the axial direction (top-to-bottom direction) of the casing (20) from the upper end of the barrel (21) of the casing (20) to the bottom (oil reservoir (26)) of the casing (20). In this example, the drive shaft (40) has a main shaft portion (41) and an eccentric shaft portion (42). The main shaft portion (41) extends in the axial direction (top-to-bottom direction) of the casing (20). The eccentric shaft portion (42) is provided at the upper end of the main shaft portion (41). The eccentric shaft portion (42) has a smaller outside diameter than the main shaft portion (41) does, and has its axis decentered by a predetermined distance with respect to the axis of the main shaft portion (41).

The drive shaft (40) has its upper end portion (i.e., its eccentric shaft portion (42)) slidably connected to the boss portion (38) of the orbiting scroll (35). In this example, the eccentric shaft portion (42) of the drive shaft (40) is rotatably supported by the boss portion (38) of the orbiting scroll (35) with the bearing metal (38*a*) interposed therebetween.

The drive shaft (40) has therein an oil supply channel (43) extending axially (in the top-to-bottom direction).

Housing

The housing (50) is in the shape of a cylinder extending in the axial direction (top-to-bottom direction) of the casing (20), and is provided below the orbiting scroll (35) inside the casing (20). The drive shaft (40) is inserted into, and runs through, the housing (50). In this example, an upper portion of the housing (50) has a larger outside diameter than a lower portion thereof does, and has an outer peripheral surface fixed to the inner peripheral surface of the barrel (21) of the casing (20). This allows the internal space of the casing (20) to be partitioned into a space above the housing (50) and the space (25) below the housing (50).

The upper portion of the housing (50) has a larger inside diameter than the lower portion thereof does, and houses therein the boss portion (38) of the orbiting scroll (35). The inner surface of the lower portion of the housing (50) rotatably supports the main shaft portion (41) of the drive shaft (40). The upper portion of the housing (50) has a recess (51) recessed downward. The recess (51) forms a crank chamber (55) that houses the boss portion 38) of the orbiting scroll (35).

The lower portion of the housing (50) forms a main bearing portion (52) that axially penetrates the housing (50) to communicate with the crank chamber (55). The main bearing portion (52) rotatably supports the main shaft portion (41) of the drive shaft (40). In this example, the bearing metal (52*a*) is fitted to the inner surface of the main bearing portion (52), which rotatably supports the main shaft portion (41) of the drive shaft (40) with this bearing metal (52*a*) interposed therebetween.

Electric Motor

The electric motor (60) drives the compression mechanism (30) via the drive shaft (40). The electric motor (60) is provided below the compression mechanism (30) inside the casing (20). Specifically, the electric motor (60) is provided below the housing (50) inside the casing (20). The electric motor (60) includes a stator (61) and a rotor (65). A balance weight (66) is attached to the lower end of the rotor (65).

Stator

The stator (61) is in the shape of a cylinder. The stator (61) is fixed to the barrel (21) of the casing (20). The stator (61) is arranged coaxially with the drive shaft (40). The stator (61) surrounds the rotor (65). The stator (61) has a core (62).

The core (62) is in the shape of a cylinder. The outer peripheral surface of the core (62) is fixed to the inner peripheral surface of the casing (20). The outer peripheral surface of the core (62) has a plurality of core cuts (62*b*).

The core cuts (62*b*) are formed at predetermined intervals along the circumferential direction of the core (62). The core cuts (62*b*) are grooves formed in the top-to-bottom direction from the upper end to the lower end of the core (62). The core cuts (62*b*) have a generally V-shaped cross section. The core cuts (62*b*) have a width that is uniform in the top-to-bottom direction.

The core cuts (62*b*) each form a first gas passage (61*a*) extending between the casing (20) and the core (62) (outside the stator (61)) in the top-to-bottom direction. The first gas passages (61*a*) are passages each formed by the associated core cut (62*b*) and the inner surface of the casing (20).

The first gas passages (61*a*) allow a refrigerant gas discharged from the compression mechanism (30) to flow down therethrough. The first gas passages (61*a*) guide the lubricant contained in the refrigerant gas discharged from the compression mechanism (30) to the bottom of the casing (20). The refrigerant gas passing through the first gas passages (61*a*) cools the electric motor (60).

The first gas passages (61*a*) extend outside the core (62) from the upper end to the lower end of the core (62) in the top-to-bottom direction. The first gas passages (61*a*) each have a width that is uniform in the top-to-bottom direction.

Rotor

The rotor (65) is in the shape of a cylinder. The rotor (65) is rotatably inserted into, and runs through, the stator (61). The rotor (65) is arranged coaxially with the drive shaft (40). The rotor (65) is arranged such that its axis extends in the top-to-bottom direction. The drive shaft (40) is inserted into, and runs through, the rotor (65), and is fixed to the inner surface of the rotor (65).

The rotor (65) has therein rotor gas passages (65*a*) that penetrate the rotor (65) in the top-to-bottom direction (the direction of its axis). In other words, the rotor gas passages (65*a*) are formed in a portion of the electric motor (60) closer to the axis of the electric motor (60) than the first gas passages (61*a*) are (a portion of the electric motor (60) located radially inward from the first gas passages (61*a*)) to extend in the top-to-bottom direction. The rotor gas passages (65*a*) are formed at predetermined intervals along the circumferential direction of the rotor (65).

Balance Weight

The balance weight (66) is provided to counteract the unbalance force induced by the orbiting motion of the compression mechanism (30). The balance weight (66) is in the shape of a cylinder. A portion of the balance weight (66) stretching generally halfway therearound is configured as a weight portion (67) protruding radially outward.

The balance weight (66) has therein weight gas passages (66*a*) that penetrate the balance weight (66) in the top-to-bottom direction (the direction of its axis). The weight gas passages (66*a*) are positioned to correspond to the associated rotor gas passages (65*a*) in the circumferential direction. In other words, the weight gas passages (66*a*) overlap with the associated rotor gas passages (65*a*) in the top-to-bottom direction. The weight gas passages (66*a*) are formed at predetermined intervals along the circumferential direction of the balance weight (66).

Cover

A cover (68) is attached to a lower portion of the rotor (65) to cover the lower end surface of the rotor (65) and the balance weight (66). The cover (68) is intended to reduce the loss of the power generated by the balance weight (66) rotating together with the rotor (65) and stirring the refrigerant gas in the casing (20). The cover (68) is arranged coaxially with the rotor (65). The cover (68) has a transverse section in the shape of a circular cap. The bottom surface of the cover (68) has a gas vent (68*a*) through which the refrigerant gas is to pass. The gas vent (68*a*) axially penetrates the bottom surface.

Here, the rotor gas passages (65*a*), the weight gas passages (66*a*), and the gas vent (68*a*) form a second gas passage (121). The second gas passage (121) is formed in the portion of the electric motor (60) closer to the axis of the electric motor (60) than the first gas passages (61*a*) are (the portion of the electric motor (60) located radially inward from the first gas passages (61*a*)) to extend in the top-to-bottom direction.

Lower Bearing Member

The lower bearing member (70) is in the shape of a cylinder extending in the axial direction (top-to-bottom direction) of the casing (20), and is provided between the electric motor (60) and the bottom (oil reservoir (26)) of the casing (20) inside the casing (20). The drive shaft (40) is inserted into, and runs through, the lower bearing member (70). In this example, the outer peripheral surface of a portion of the lower bearing member (70) protrudes radially outward, and is fixed to the inner peripheral surface of the barrel (21) of the casing (20).

An upper portion of the lower bearing member (70) has a smaller inside diameter than a lower portion thereof does. The inner surface of the upper portion of the lower bearing member (70) rotatably supports the main shaft portion (41) of the drive shaft (40). The lower portion of the lower bearing member (70) houses therein a lower end portion of the main shaft portion (41) of the drive shaft (40). The lower portion of the lower bearing member (70) has a lower recess (71) recessed upward. The lower recess (71) houses the lower end portion of the main shaft portion (41) of the drive shaft (40).

The upper portion of the lower bearing member (70) forms a lower bearing portion (72) that axially penetrates the lower bearing member (70) to communicate with a space inside the lower recess (71). The lower bearing portion (72) rotatably supports the main shaft portion (41) of the drive shaft (40). In this example, a bearing metal (72*a*) is fitted to the inner surface of the lower bearing portion (72), which rotatably supports the main shaft portion (41) of the drive shaft (40) with this bearing metal (72*a*) interposed therebetween.

Oil Pump

The oil pump (80) is provided at the lower end of the drive shaft (40), and is attached to the lower surface of the lower hearing member (70) to close the lower recess (71) of the lower bearing member (70). In this example, an intake nozzle (81) is provided as an intake member for sucking up oil. The intake nozzle (81) constitutes a positive-displacement oil pump (80). An inlet (81*a*) of the intake nozzle (81) is open to the oil reservoir (26) of the casing (20). An outlet of the intake nozzle (81) is connected to the lower recess (71) to communicate with the lower recess (71). The lubricant sucked up from the oil reservoir (26) by the intake nozzle (81) flows through the oil supply channel (43) via the lower recess (71), and is supplied to the sliding components of the compressor (10).

Oil Discharge Guide

The housing (50) has the oil discharge passage (56) through which the lubricant remaining in the crank chamber (55) is to be discharged to the outside of the housing (50). The oil discharge passage (56) allows the crank chamber (55) to communicate with the space (25) below the housing (50). Specifically, the oil discharge passage (56) extends radially outward from the recess (51) of the housing (50), and opens through the side surface of the housing (50).

The downstream side of the oil discharge passage (56) is connected to an oil discharge guide (90). Specifically, the outflow end of the oil discharge passage (56) is connected to a circular pipe portion (92) of the oil discharge guide (90), which will be described below. The oil discharge guide (90) is a member configured to guide the lubricant that has flowed out of the oil discharge passage (56) to the space (25) below the housing (50). The oil discharge guide (90) includes a guide portion (91) and the circular pipe portion (92).

The guide portion (91) is a hollow member having a flat rectangular parallelepiped shape. The guide portion (91) has a closed upper end and an open lower end. The circular pipe portion (92) penetrates a sidewall portion of the guide portion (91). The circular pipe portion (92) is provided along the oil discharge passage (56). The guide portion (91) is provided along the inner peripheral surface of the barrel (21) of the casing (20). The oil discharge guide (90) has therein an oil discharge guide passage (90*a*) through which the lubricant is to pass. This oil discharge guide passage (90*a*) has a first oil discharge passage (92*a*) and a second oil discharge passage (91*a*).

The first oil discharge passage (92*a*) extends radially outward from the outflow end of the oil discharge passage (56). The second oil discharge passage (91*a*) extends downward from a front end portion of the first oil discharge passage (92*a*). The second oil discharge passage (91*a*) is formed along the inner peripheral surface of the barrel (21) of the casing (20). A front end portion of the second oil discharge passage (91*a*) opens to the space (25) below the housing (50). A downstream portion of the second oil discharge passage (91*a*) is inserted into an oil return plate (100), which will be described below.

Oil Return Plate

As illustrated in FIG. 1, the oil return plate (100) (oil return member) is provided in the casing (20) to guide the lubricant discharged from the compression mechanism (30) downward. The oil return plate (100) is a plate-shaped member that covers a portion of the inner peripheral surface of the casing (20) in the top-to-bottom direction. The oil return plate (100) is provided between the compression mechanism (30) and the electric motor (60). An oil return flow path (130) is formed between the oil return plate (100) and the inner peripheral surface of the casing (20).

Figure 2:
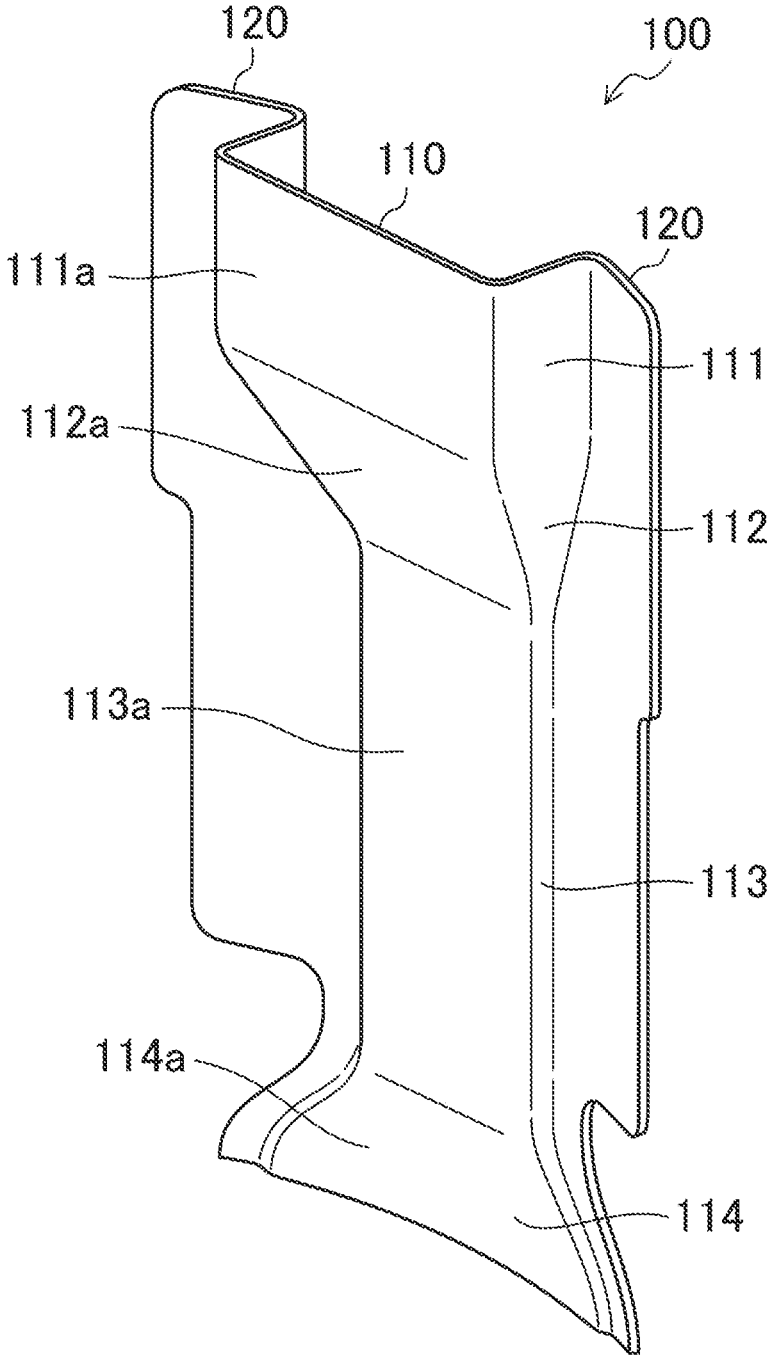
FIG. 2 is a perspective view illustrating, an oil return plate.

As illustrated in FIG. 2, the oil return plate (100) includes a body portion (110) and flange portions (120). The body portion (110) is a plate-shaped portion recessed from the inner peripheral surface of the barrel (21) of the casing (20) toward the axis of the casing (20). The flange portions (120) are plate-shaped portions that extend on both sides of the body portion (110) while being curved along the inner peripheral surface of the barrel (21) of the casing (20).

The body portion (110) includes an upper vertical recessed portion (111), an upper inclined recessed portion (112), a lower vertical recessed portion (113), and a lower inclined recessed portion (114). The upper vertical recessed portion (111), the upper inclined recessed portion (112), the lower vertical recessed portion (113), and the lower inclined recessed portion (114) are continuously formed in this order from the top to the bottom.

Figure 3:
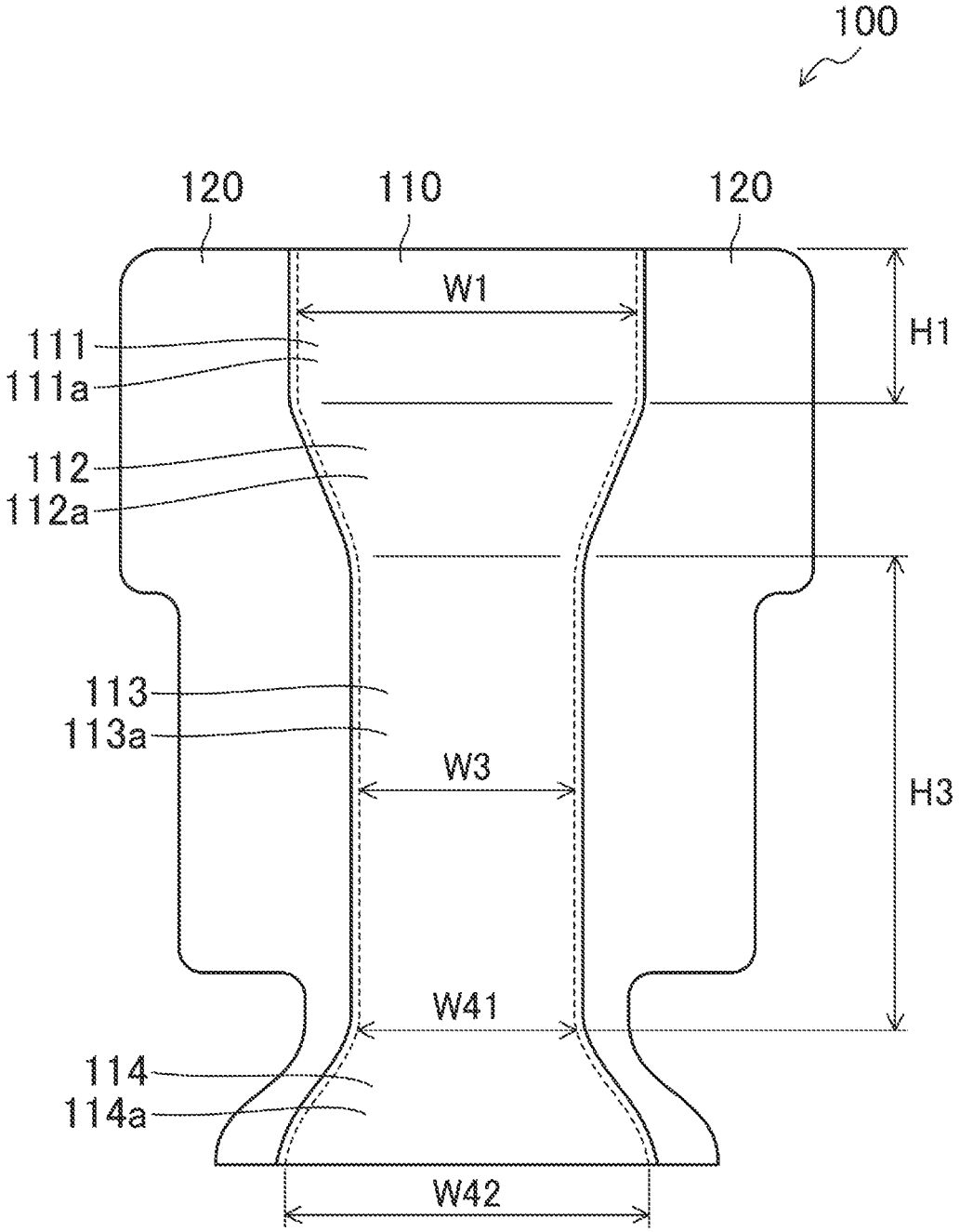
FIG. 3 is a front view illustrating the oil return plate.

A bottom portion (111*a*) of the upper vertical recessed portion (111) and a bottom portion (113*a*) of the lower vertical recessed portion (113) are formed in the shape of a rectangle extending in the vertical direction. As illustrated in FIG. 3, the bottom portion (111*a*) of the upper vertical recessed portion (111) has long sides extending in the right-to-left direction, and short sides extending in the top-to-bottom direction. The height (length in the top-to-bottom direction) of the bottom portion (111*a*) of the upper vertical recessed portion (111) is smaller than that of the bottom portion (113*a*) of the lower vertical recessed portion (113). The bottom portion (113*a*) of the lower vertical recessed portion (113) has long sides extending in the top-to-bottom direction, and short sides extending in the right-to-left direction. The height of the bottom portion (113*a*) of the lower vertical recessed portion (113) is greatest among the heights of the constituent portions of the body portion (110).

The bottom portion (111*a*) of the upper vertical recessed portion (111) and the bottom portion (113*a*) of the lower vertical recessed portion (113) each have a width (circumferential length) that is uniform in the top-to-bottom direction. The width of the lower vertical recessed portion (113) is smaller than that of the upper vertical recessed portion (111). In other words, the width of the bottom portion (113*a*) of the lower vertical recessed portion (113) is smaller than that of the bottom portion (111*a*) of the upper vertical recessed portion (111).

Figure 4:
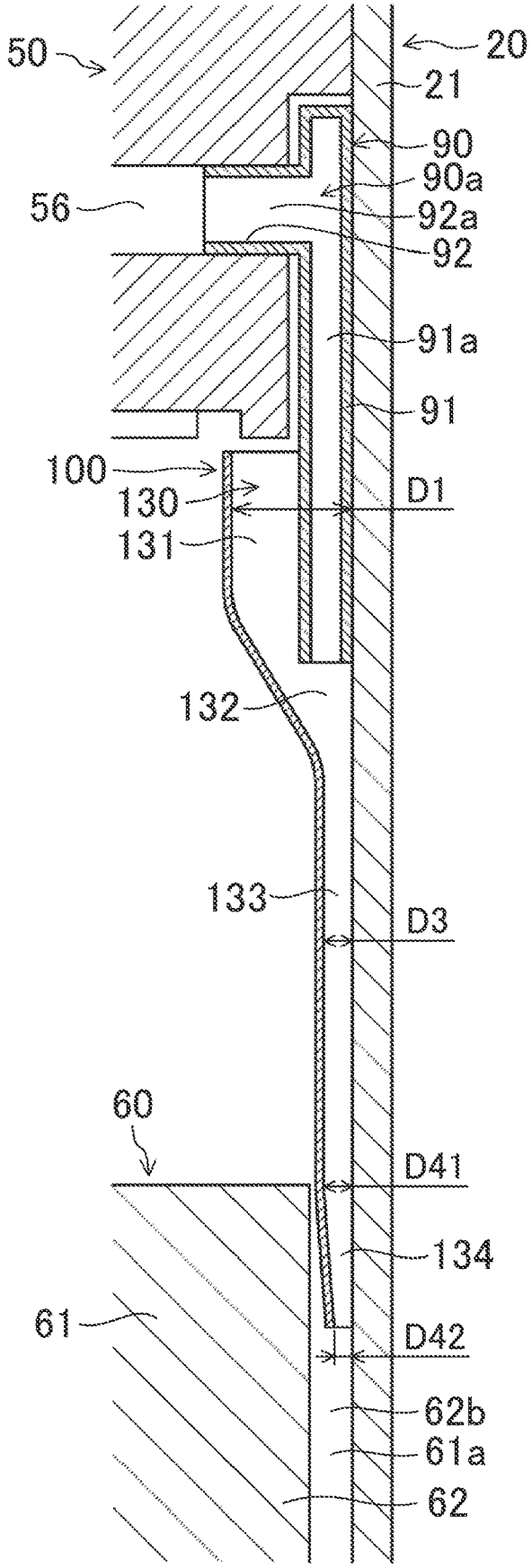
FIG. 4 is an enlarged sectional view of the oil return plate and its surrounding area illustrated in FIG. 1.

As illustrated in FIG. 4, the upper vertical recessed portion (111) and the lower vertical recessed portion (113) each have a uniform depth. The lower vertical recessed portion (113) is shallower than the upper vertical recessed portion (111). In other words, the bottom portion (113*a*) of the lower vertical recessed portion (113) is closer to the inner peripheral surface of the casing (20) than the bottom portion (111*a*) of the upper vertical recessed portion (111) is.

The bottom portion (112*a*) of the upper inclined recessed portion (112) connects the bottom portion (111*a*) of the upper vertical recessed portion (111) and the bottom portion (113*a*) of the lower vertical recessed portion (113) together. The bottom portion (112*a*) of the upper inclined recessed portion (112) connects the bottom portion (111*a*) of the upper vertical recessed portion (111) with a greater width and the bottom portion (113*a*) of the lower vertical recessed portion (113) with a smaller width together. In other words, the width of the bottom portion (112*a*) of the upper inclined recessed portion (112) decreases downward.

The lower end of the upper inclined recessed portion (112) has a smaller depth than the upper end thereof. The depth of the bottom portion (112*a*) of the upper inclined recessed portion (112) gradually decreases downward. In other words, the bottom portion (112*a*) of the upper inclined recessed portion (112) is inclined downward toward the inner peripheral surface of the casing (20).

The upper end of the bottom portion (114*a*) of the lower inclined recessed portion (114) is continuous with the lower end of the bottom portion (113*a*) of the lower vertical recessed portion (113). The lower end of the bottom portion (114*a*) of the lower inclined recessed portion (114) has a greater width than the upper end thereof does. The width of the bottom portion (114*a*) of the lower inclined recessed portion (114) gradually increases downward. The width of the lower end of the bottom portion (114*a*) of the lower inclined recessed portion (114) is greater than that of the bottom portion (111*a*) of the upper vertical recessed portion (111). In other words, the width of the lower end of the bottom portion (114*a*) of the lower inclined recessed portion (114) is greatest among the widths of the constituent portions of the body portion (110).

The lower end of the lower inclined recessed portion (114) has a smaller depth than the upper end thereof. The depth of the lower inclined recessed portion (114) gradually decreases downward. In other words, the bottom portion (114*a*) of the lower inclined recessed portion (114) is inclined downward toward the inner peripheral surface of the casing (20). The depth of the lower inclined recessed portion (114) is smallest among the depths of the constituent portions of the body portion (110).

The lower inclined recessed portion (114) is inserted into one of the first gas passages (61*a*), Specifically, the bottom portion (114*a*) of the lower inclined recessed portion (114) is inclined downward in a direction away from the associated core cut (62*b*) of the electric motor (60).

As illustrated in FIG. 4, the oil return flow path (130) allows the oil discharge passage (56) of the housing (50) to communicate with the one of the first gas passages (61*a*) of the electric motor (60) in the top-to-bottom direction. The oil return flow path (130) includes a first flow path (131), a second flow path (132), a third flow path (133) (uniform-cross-section flow path), and a fourth flow path (134) (varying-cross-section flow path). The first flow path (131), the second flow path (132), the third flow path (133), and the fourth flow path (134) are formed in this order from the top to the bottom.

The first flow path (131) is formed between the inner peripheral surface of the casing (20) and the upper vertical recessed portion (111) of the oil return plate (100). The second flow path (132) is formed between the inner peripheral surface of the casing (20) and the upper inclined recessed portion (112) of the oil return plate (100). The third flow path (133) is formed between the inner peripheral surface of the casing (20) and the lower vertical recessed portion (113) of the oil return plate (100). The fourth flow path (134) is formed between the inner peripheral surface of the casing (20) and the lower inclined recessed portion (114) of the oil return plate (100). The upper end of the first flow path (131) constitutes the inlet of the oil return flow path (130), and the lower end of the fourth flow path (134) constitutes the outlet of the oil return flow path (130).

Each of the first and third flow paths (131) and (133) has a generally rectangular transverse section with long sides extending in the circumferential direction and short sides extending in the radial direction. In other words, the transverse section of the first flow path (131) is in the shape of a rectangle with long sides having a length W1 and short sides having a length D1. The transverse section of the third flow path (133) is in the shape of a rectangle with long sides having a length W3 and short sides having a length D3.

As illustrated in FIG. 3, the width W1 (circumferential length) of the first flow path (131) and the width W3 of the third flow path (133) are uniform in the top-to-bottom direction. The width W3 of the third flow path (133) is smaller than the width W1 of the first flow path (131) (W3<W1), and is smallest among the widths of the flow paths included in the oil return flow path (130).

As illustrated in FIG. 4, the thickness D1 (radial length) of the first flow path (131) and the thickness D3 of the third flow path (133) are uniform in the top-to-bottom direction. The thickness D3 of the third flow path (133) is smaller than the thickness D1 of the first flow path (131) (D3<D1). The first and third flow paths (131) and (133) each have a transverse sectional shape that is generally uniform in the top-to-bottom direction. The cross-sectional area of the third flow path (133) is smaller than that of the first flow path (131) (W3×D3<W1×D1).

As illustrated in FIG. 3, the height H3 (length in the top-to-bottom direction) of the third flow path (133) is greater than the height H1 of the first flow path (131) (H3>H1), and is greatest among the heights of the flow paths included in the oil return flow path (130). The lower end of the first flow path (131) is continuous with the upper end of the second flow path (132). The upper end of the third flow path (133) is continuous with the lower end of the second flow path (132), and the lower end of the third flow path (133) is continuous with the upper end of the fourth flow path (134).

The second flow path (132) has a generally rectangular transverse section with long sides extending in the circumferential direction and short sides extending in the radial direction. The second flow path (132) connects the first and third flow paths (131) and (133) together. Specifically, the upper end of the second flow path (132) is continuous with the lower end of the first flow path (131), and the lower end of the second flow path (132) is continuous with the upper end of the third flow path (133). The width of the second flow path (132) gradually decreases downward. The thickness of the second flow path (132) gradually decreases downward.

The second flow path (132) connects the first flow path (131) with a larger transverse-sectional area and the third flow path (133) with a smaller transverse-sectional area together. In other words, the transverse-sectional area of the second flow path (132) gradually decreases downward.

A downstream portion of the oil discharge guide (90) is inserted into a portion of the oil return flow path (130) from the first flow path (131) to a middle portion of the second flow path (132). In other words, the lower end of the oil discharge guide (90) is located in the middle portion of the second flow path (132) in the oil return flow path (130).

The fourth flow path (134) has a generally rectangular transverse section with long sides extending in the circumferential direction and short sides extending in the radial direction. Specifically, the transverse section of the upper end of the fourth flow path (134) is in the shape of a rectangle with long sides having a length W41 and short sides having a length D41. The transverse section of the lower end of the fourth flow path (134) is in the shape of a rectangle with long sides having a length W42 and short sides having a length D42. The upper end of the fourth flow path (134) is continuous with the lower end of the third flow path (133).

The width W42 of the lower end of the fourth flow path (134) is greater than the width W41 of the upper end thereof (W41<W42). The width of the transverse section of the fourth flow path (134) gradually increases downward (specifically, from the upper end to the lower end thereof). The width W42 of the lower end of the fourth flow path (134) is greater than the width W1 of the first flow path (131) (W42>W1). The width W42 of the lower end of the fourth flow path (134) is greatest among the widths of the flow paths included in the oil return flow path (130).

The thickness D42 of the lower end of the fourth flow path (134) is smaller than the thickness D41 of the upper end thereof (D41>D42). The thickness of the transverse section of the fourth flow path (134) gradually decreases downward (specifically, from the upper end to the lower end thereof). The thickness D42 of the lower end of the fourth flow path (134) is smallest among the thicknesses of the flow paths included in the oil return flow path (130). In other words, the shape (specifically, width and thickness) of the transverse section of the fourth flow path (134) varies downward.

The transverse-sectional area of the lower end of the fourth flow path (134) is equal to the transverse-sectional area of the upper end thereof (W41×D41=W42×D42). The transverse-sectional area of the fourth flow path (134) is uniform from the upper end to the lower end thereof. The lower end of the fourth flow path (134) lies along the inner peripheral surface of the casing (20). The lower end of the fourth flow path (134) is inserted into the one of the first gas passages (61*a*) formed between the electric motor (60) and the casing (20).

The flange portions (120) extend continuously from both lateral ends of the body portion (110) in the circumferential direction and in the top-to-bottom direction. The flange portions (120) each have an arc-shaped transverse section. The radius of curvature of the outer surface of the flange portion (120) corresponds to that of the inner peripheral surface of the barrel (21) of the casing (20). The oil return plate (100) is fixed to the casing (20) such that the outer surfaces of the flange portions (120) are in close contact with the inner peripheral surface of the barrel (21) of the casing (20).

Operation of Compressor

Next, an operation of the compressor (10) will be described.

When the electric motor (60) is driven, the drive shaft (40) rotates so that the orbiting scroll (35) of the compression mechanism (30) is driven. The orbiting scroll (35) revolves around the axis of the drive shaft (40) while having its rotation restricted. As a result, the low-pressure fluid (e.g., low-pressure gas refrigerant) is sucked from the suction pipe (27) into the compression chamber (C) of the compression mechanism (30), and is compressed. The fluid compressed in the compression chamber (C) (i.e., high-pressure fluid) is discharged through the discharge port (P) of the fixed scroll (31) to the discharge chamber (S).

The high-pressure fluid (e.g., high-pressure gas refrigerant) that has flowed into the discharge chamber (S) flows out of the discharge chamber (S) to the space (25) below the housing (50) through the discharge passage (not shown) formed in the fixed scroll (31) and the housing (50). The high-pressure fluid that has flowed into the space (25) below the housing (50) is discharged to the outside of the casing (20) (e.g., the condenser of the refrigerant circuit) through the discharge pipe (28).

Flow of Lubricant

Next, the flow of the lubricant in the compressor (10) will be described.

The lubricant stored in the oil reservoir (26) is sucked into the oil pump (80), and is discharged to the oil supply channel (43). The discharged lubricant moves upward through the oil supply channel (43), and is supplied to the compression mechanism (30). The lubricant used to lubricate the boss portion (38) of the compression mechanism (30) flows into the crank chamber (55), and is returned to the oil reservoir (26) through the oil discharge guide (90).

The lubricant that has flowed out of the compression mechanism (30) flows into the oil return flow path (130) via the oil discharge passage (56) and the oil discharge guide (90). The lubricant that has flowed out of the lower end of the oil discharge guide (90) flows downward along a portion of the inner wall of the casing (20) corresponding to the oil return flow path (130) by gravitation while being in the form of an oil film.

The lubricant that has reached the fourth flow path (134) flows downward while spreading in the circumferential direction along the inner wall of the casing (20) with increasing width of the fourth flow path (134). At this time, an oil film with a thickness less than or equal to half the thickness of the fourth flow path (134) is formed. Most of the lubricant flows along the inner wall of the casing (20). This reduces the amount of oil blown off by the refrigerant gas in the course from the lower end of the one of the first gas passages (61*a*) to the bottom of the casing (20).

The lubricant that has flowed out of the oil return flow path (130) is guided to the one of the first gas passages (61*a*). The lubricant introduced into the one of the first gas passages (61*a*) flows downward along the one of the first gas passages (61*a*) from the upper end to the lower end of the one of the first gas passages (61*a*). The lubricant that has reached the lower end of the one of the first gas passages (61*a*) flows directly along the inner wall of the casing (20) to the bottom of the casing (20). Thus, the lubricant returns to the bottom of the casing (20) without being contained in the refrigerant gas.

Feature (1) of Embodiment

The compressor (10) of this embodiment includes the casing (20) configured to store lubricant at its bottom, the compression mechanism (30) provided in the casing (20) to suck, and compress, a refrigerant, and the oil return plate (100) forming the oil return flow path (130) that extends in the top-to-bottom direction to guide the lubricant discharged from the compression mechanism (30) downward. The oil return flow path (130) includes the third flow path (133) having a uniform cross-sectional shape, and the fourth flow path (134) being continuous with the lower end of the third flow path (133) and having a cross-sectional shape that varies. The lower end of the fourth flow path (134) forms the outlet of the oil return flow path (130), and lies along the inner surface of the casing (20). The cross section of the lower end of the fourth flow path (134) has a greater width and a smaller thickness than the cross section of the upper end thereof.

In the compressor (10) of this embodiment, the cross section of the lower end of the fourth flow path (134) has a greater width and a smaller thickness than the cross section of the upper end thereof. For this reason, the lubricant flowing down through the fourth flow path (134) forms a film along the inner surface of the casing (20), and most of the lubricant flows down along the inner surface of the casing (20). Thus, according to this aspect, the amount of the lubricant splashing in the oil return flow path (130) decreases. This can reduce the amount of the lubricant flowing out of the compressor (10).

Feature (2) of Embodiment

In the compressor (10) of this embodiment, the cross section of the fourth flow path (134) has its width gradually increased, and has its thickness gradually reduced, from the upper end toward the lower end of the fourth flow path (134).

In the compressor (10) of this embodiment, the cross-sectional shape of the fourth flow path (134) varies gradually. This allows the lubricant to be smoothly passed through the fourth flow path (134).

Feature (3) of Embodiment

In the compressor (10) of this embodiment, the cross-sectional area of the lower end of the fourth flow path (134) is larger than or equal to the cross-sectional area of the upper end of the fourth flow path (134).

In the compressor (10) of this embodiment, the flow rate of the lubricant through the lower end of the fourth flow path (134) is lower than or equal to the flow rate of the lubricant through the upper end thereof. This makes it easier for the lubricant to move along the inner surface of the casing (20).

Feature (4) of Embodiment

In the compressor (10) of this embodiment, the cross-sectional area of the fourth flow path (134) is uniform from the upper end to the lower end of the fourth flow path (134), or increases gradually from the upper end toward the lower end of the fourth flow path (134).

In the compressor (10) of this embodiment, the cross-sectional shape of the fourth flow path (134) varies gradually, and the flow rate of the lubricant through the lower end of the fourth flow path (134) is lower than or equal to the flow rate of the lubricant through the upper end thereof. This makes it easier for the lubricant to move along the inner surface of the casing (20) while being smoothly passed through the fourth flow path (134).

Feature (5) of Embodiment

The oil return member (100) of the compressor (10) of this embodiment has a plate shape that covers the inner surface of the casing (20). The oil return flow path (130) is formed between the oil return member (100) and the inner surface of the casing (20).

The oil return member (100) of the compressor (10) of this embodiment is plate-shaped. Thus, the oil return flow path (130) can be formed by the oil return member (100) with a simple structure.

Variations of Embodiment

Figure 5:
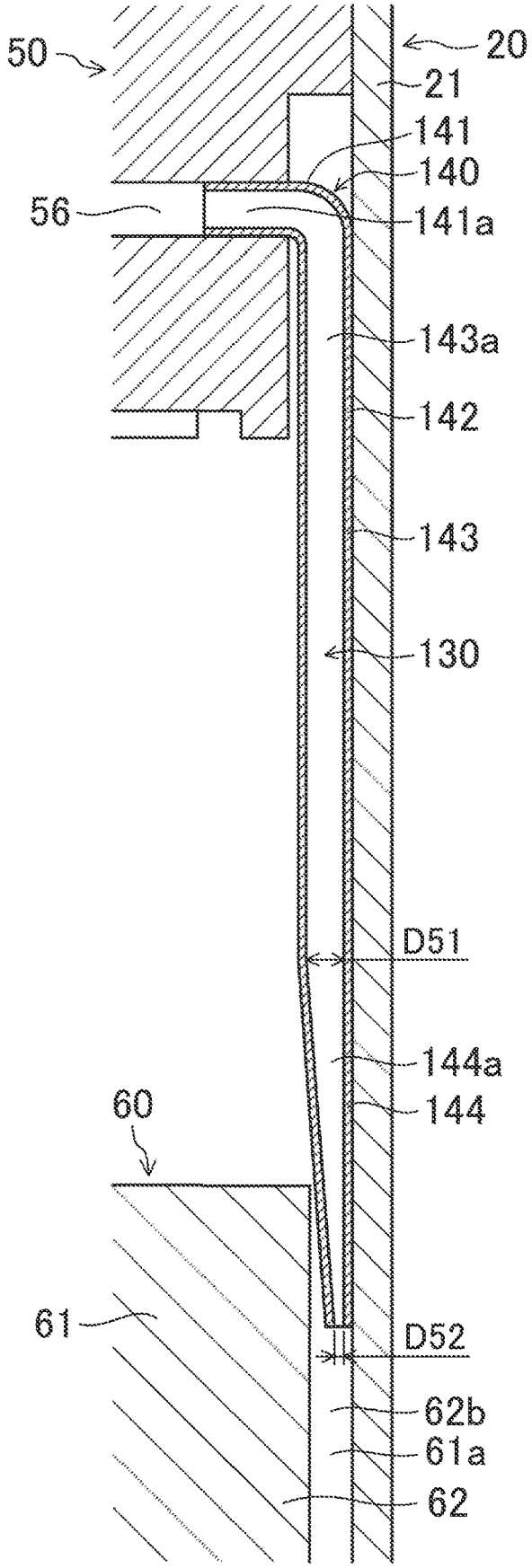
FIG. 5 corresponds to FIG. 4 and illustrates a variation of the embodiment.
Figure 6:
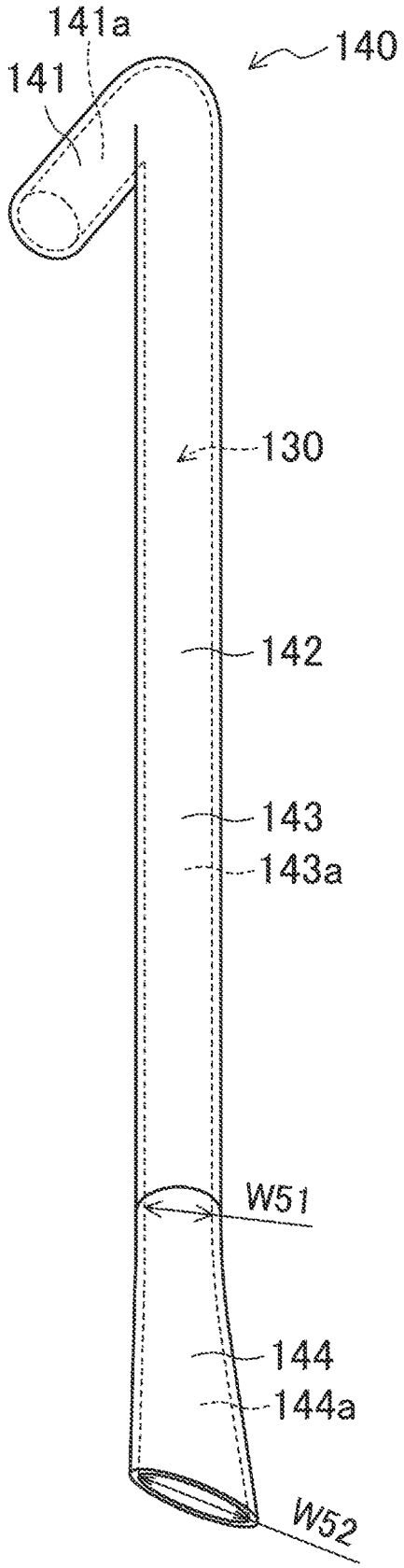
FIG. 6 is a perspective view of an oil return pipe according to the variation of the embodiment.

As illustrated in FIGS. 5 and 6, the oil return member of the compression mechanism (30) of this embodiment may include the oil discharge guide (90) and the oil return plate (100) integrated together. Specifically, the oil return member may be an oil return pipe (140) formed into a tubular shape. The oil return pipe (140) guides lubricant that has flowed out of the oil discharge passage (56) to one of the first gas passages (61*a*) of the electric motor (60).

The oil return pipe (140) is connected to the oil discharge passage (56), and has a generally U-shaped vertical cross section. Specifically, the oil return pipe (140) extends radially outward from the front end of the oil discharge passage (56), then bends downward, extends downward along the inner peripheral surface of the casing (20), and opens into the one of the first gas passages (61*a*) of the electric motor (60). The oil return pipe (140) includes a horizontal portion (141) and a vertical portion (142).

The inflow end of the horizontal portion (141) is connected to the front end of the ail discharge passage (56). The horizontal portion (141) is in the shape of a straight pipe having a uniform inside diameter along its entire length. The horizontal portion (141) extends radially outward from the oil discharge passage (56). The horizontal portion (141) is formed continuously with the vertical portion (142).

The vertical portion (142) is a pipe extending downward from the outflow end of the horizontal portion (141). The vertical portion (142) extends along the inner peripheral surface of the casing (20). The vertical portion (142) includes a straight portion (143) and a flat portion (144). The straight portion (143) and the flat portion (144) are continuously formed in this order from the top to the bottom. The straight portion (143) is in the shape of a straight pipe having a uniform inside diameter along its entire length. The flat portion (144) is formed continuously with the lower end of the straight portion (143). The flat portion (144) has an upper end in the shape of a circular pipe, and a lower end in the shape of a flat pipe with an elliptical cross section.

An oil return flow path (130) is formed inside the oil return pipe (140). The oil return flow path (130) includes a horizontal flow path (141*a*), a vertical flow path (143*a*) (uniform-cross-section flow path), and an inclined flow path (144*a*) (varying-cross-section flow path). The horizontal flow path (141*a*), the vertical flow path (143*a*), and the inclined flow path (144*a*) are continuous in this order from the top to the bottom. The horizontal flow path (141*a*) is formed inside the horizontal portion (141). The vertical flow path (143*a*) is formed inside the straight portion (143). The inclined flow path (144*a*) is formed inside the flat portion (144).

The end of the horizontal flow path (141*a*) constitutes the inlet of the oil return flow path (130), and the lower end of the inclined flow path (144*a*) constitutes the outlet of the oil return flow path (130). The horizontal flow path (141*a*) extends radially outward from the outflow end of the oil discharge passage (56). The horizontal flow path (141*a*) has a circular cross section. The horizontal flow path (141*a*) has a diameter that is uniform in the radial direction.

The vertical flow path (143*a*) extends downward from the front end of the horizontal flow path (141*a*) along the inner peripheral surface of the casing (20). The vertical flow path (143*a*) has a circular cross section. The vertical flow path (143*a*) has a diameter that is uniform in the top-to-bottom direction.

The inclined flow path (144*a*) extends downward from the front end of the vertical flow path (143*a*) along the inner peripheral surface of the casing (20). The upper end of the inclined flow path (144*a*) has a circular cross section. The lower end of the inclined flow path (144*a*) has an elliptical cross section with a major axis extending along the inner wall of the casing (20). Specifically, the width W52 of the lower end of the inclined flow path (144*a*) is greater than the width W51 of the upper end thereof (W51<W52). The width of the inclined flow path (144*a*) gradually increases downward. The thickness D52 of the lower end of the inclined flow path (144*a*) is smaller than the thickness D51 of the upper end thereof (D51>D52). The thickness of the inclined flow path (144*a*) gradually decreases downward.

The transverse-sectional area of the lower end of the inclined flow path (144*a*) is equal to the transverse-sectional area of the upper end thereof. The transverse-sectional area of the inclined flow path (144*a*) is uniform from the upper end to the lower end thereof. The lower end of the inclined flow path (144*a*) lies along the inner peripheral surface of the casing (20). The lower end of the inclined flow path (144*a*) is inserted into the one of the first gas passages (61*a*) brined between the electric motor (60) and the casing (20).

Other Embodiments

The foregoing embodiment may be modified as follows.

The compressor (10) of the foregoing embodiment may be a compressor except a scroll compressor (e.g., a rotary compressor).

The cover (68) of the foregoing embodiment does not need to be attached to the rotor (65).

The oil discharge guide (90) of the foregoing embodiment may be configured as a tubular member.

The cross-sectional area of the lower end of the varying-cross-section flow path (134, 144*a*) of the foregoing embodiment may be larger than or equal to that of the upper end thereof. The cross-sectional area of the varying-cross-section flow path (134, 144*a*) may increase gradually from the upper end toward the lower end thereof.

While the embodiment and variations thereof have been described above, it will be understood that various changes in form and details may be made without departing from the spirit and scope of the claims. The embodiment and the variations thereof may be combined and replaced with each other without deteriorating intended functions of the present disclosure.

As can be seen from the foregoing description, the present disclosure is useful for a compressor.

The invention claimed is:

1. A compressor comprising:

a casing configured to store lubricant at a bottom of the casing;

a compression mechanism disposed in the casing, the compression mechanism being configured to suck and compress a refrigerant; and an oil return member forming an oil return flow path that extends in a top-to-bottom direction to guide the lubricant discharged from the compression mechanism downward, the oil return flow path including a uniform-cross-section flow path having a uniform cross-sectional shape, and a varying-cross-section flow path continuous with a lower end of the uniform-cross-section flow path and having a cross-sectional shape that varies, a lower end of the varying-cross-section flow path forming an outlet of the oil return flow path and lying along an inner surface of the casing, in a case in which a length of a cross section of the varying-cross-section flow path along the inner surface of the casing is a width, and a length of the cross section of the varying-cross-section flow path perpendicular to the inner surface of the casing is a thickness, a cross section of the lower end of the varying-cross-section flow path having a greater width than a cross section of an upper end of the varying-cross-section flow path, and the cross section of the lower end of the varying-cross-section flow path having a smaller thickness than a thickness of the cross section of the upper end of the varying-cross-section flow path.

2. The compressor of claim 1, wherein the cross section of the varying-cross-section flow path has a width that increases gradually, and a thickness that decreases gradually, from the upper end toward the lower end of the varying-cross-section flow path.

3. The compressor of claim 2, wherein a cross-sectional area of the lower end of the varying-cross-section flow path is larger than or equal to a cross-sectional area of the upper end of the varying-cross-section flow path.

4. The compressor of claim 3, wherein a cross-sectional area of the varying-cross-section flow path is uniform from the upper end to the lower end of the varying-cross-section flow path, or increases gradually from the upper end toward the lower end of the varying-cross-section flow path.

5. The compressor of claim 4, wherein the oil return member has a plate shape that covers the inner surface of the casing, and the oil return flow path is formed between the oil return member and the inner surface of the casing.

6. The compressor of claim 3, wherein the oil return member has a plate shape that covers the inner surface of the casing, and the oil return flow path is formed between the oil return member and the inner surface of the casing.

7. The compressor of claim 2, wherein a cross-sectional area of the varying-cross-section flow path is uniform from the upper end to the lower end of the varying-cross-section flow path, or increases gradually from the upper end toward the lower end of the varying-cross-section flow path.

8. The compressor of claim 7, wherein the oil return member has a plate shape that covers the inner surface of the casing, and the oil return flow path is formed between the oil return member and the inner surface of the casing.

9. The compressor of claim 2, wherein the oil return member has a plate shape that covers the inner surface of the casing, and the oil return flow path is formed between the oil return member and the inner surface of the casing.

10. The compressor of claim 1, wherein a cross-sectional area of the lower end of the varying-cross-section flow path is larger than or equal to a cross-sectional area of the upper end of the varying-cross-section flow path.

11. The compressor of claim 10, wherein a cross-sectional area of the varying-cross-section flow path is uniform from the upper end to the lower end of the varying-cross-section flow path, or increases gradually from the upper end toward the lower end of the varying-cross-section flow path.

12. The compressor of claim 11, wherein the oil return member has a plate shape that covers the inner surface of the casing, and the oil return flow path is formed between the oil return member and the inner surface of the casing.

13. The compressor of claim 10, wherein the oil return member has a plate shape that covers the inner surface of the casing, and the oil return flow path is formed between the oil return member and the inner surface of the casing.

14. The compressor of claim 1, wherein a cross-sectional area of the varying-cross-section flow path is uniform from the upper end to the lower end of the varying-cross-section flow path, or increases gradually from the upper end toward the lower end of the varying-cross-section flow path.

15. The compressor of claim 14, wherein the oil return member has a plate shape that covers the inner surface of the casing, and the oil return flow path is formed between the oil return member and the inner surface of the casing.

16. The compressor of claim 1, wherein the oil return member has a plate shape that covers the inner surface of the casing, and the oil return flow path is formed between the oil return member and the inner surface of the casing.

* * * * *